US007459853B2

(12) United States Patent
Hsu

(10) Patent No.: US 7,459,853 B2
(45) Date of Patent: Dec. 2, 2008

(54) PLASMA DISPLAY PANEL FOR PRODUCING HIGH COLOR TEMPERATURE WHITE LIGHT AND UPPER SUBSTRATE THEREOF

(75) Inventor: Chao-Hung Hsu, Taichung County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 0 days.

(21) Appl. No.: 11/308,968

(22) Filed: Jun. 1, 2006

(65) Prior Publication Data

US 2007/0278957 A1 Dec. 6, 2007

(51) Int. Cl.
*H01J 17/49* (2006.01)

(52) U.S. Cl. ..... 313/584; 313/582

(58) Field of Classification Search ..... None
See application file for complete search history.

(56) References Cited

U.S. PATENT DOCUMENTS 6,348,762 B1 * 2/2002 Nunomura et al. ..... 313/582
6,373,195 B1 * 4/2002 Whang et al. ..... 315/169.3
6,452,333 B1 * 9/2002 Torisaki et al. ..... 313/586
6,819,046 B2 11/2004 Hirano ..... 313/582
6,838,825 B2 1/2005 Shiiki et al. ..... 313/582
6,867,545 B2 3/2005 Lee ..... 313/582
2004/0032215 A1 * 2/2004 Nishimura et al. ..... 315/169.3
2006/0001354 A1 * 1/2006 Chen et al. ..... 313/491

* cited by examiner

*Primary Examiner*—Toan Ton
*Assistant Examiner*—Britt Hanley
(74) *Attorney, Agent, or Firm*—Jianq Chyun IP Office

(57) ABSTRACT

A plasma display panel, including a lower substrate and an upper substrate, is provided. The lower substrate includes a first substrate, data electrodes, a rib structure and a fluorescent layer. The data electrodes are disposed on the first substrate. The rib structure is disposed on the first substrate and covering the data electrodes. The fluorescent layer is disposed on a surface of the rib structure. The upper substrate is disposed over the lower substrate, and configures a plurality of first, second, and third discharging spaces with the rib structure of the lower substrate. The upper substrate includes a second substrate and bus electrodes disposed on the second substrate. Each of the bus electrodes includes electrode lines and connecting sessions to electrically connect the electrode lines. The bus electrodes corresponding to respectively the first, second and third discharging spaces are different in structure.

16 Claims, 9 Drawing Sheets

PLASMA DISPLAY PANEL FOR PRODUCING HIGH COLOR TEMPERATURE WHITE LIGHT AND UPPER SUBSTRATE THEREOF

BACKGROUND OF THE INVENTION

1. Field of the Invention

The present invention relates to a display panel and an upper substrate thereof, and particularly to a plasma display panel (PDP) and an upper substrate thereof.

2. Description of Related Art

As an important human-computer interface, the flat display can be categorized into several kinds, such as plasma display panel (PDP), organic electro-luminescent display (OLED), liquid crystal display (LCD) and light emitting diode (LED) display. PDPs, with such advantages of larger size, self-illumination, no view angle dependence, thinness and full color display, have the potential to become a mainstream flat display of the next generation.

Generally, PDPs apply the characteristic in a phosphor material or a fluorescent material which can emit a visible light when illuminated by an ultraviolet light. The PDP light-emitting structure generally comprises a pair of electrodes (anode electrode and cathode electrode), a discharging gas and a phosphor layer (or a fluorescent layer). When a voltage applied between the anode electrode and the cathode electrode exceeds a firing value of the discharge gas, the discharging gas discharges and emits an ultraviolet light. The ultraviolet light illuminates the phosphor layer (or the fluorescent layer), and the phosphor layer (or the fluorescent layer) is then excited to an excited state. During a subsequent process when the phosphor layer (or the fluorescent layer) returns from the excited state back to a ground state, the phosphor layer (or the fluorescent layer) emits visible lights of different colors according to different material characteristics of the phosphor layer (or the fluorescent layer). This is a light emitting principle of a typical PDP.

According to a color reproducibility specification established by the National Television System Committee (NTSC), in order to obtain a white light having a high color temperature, the luminance requirement for the red light, green light and blue light which are combined into such a white light are different. Since images with higher color temperatures appear sharper image quality in human eyes, PDPs are developing to produce images having higher color temperatures.

FIG. 1 is a schematic structural view of a conventional PDP. Referring to FIG. 1, the conventional PDP 40 includes an upper substrate 10, a lower substrate 20, and a discharging gas 30 filled between the upper substrate 10 and the lower substrate 20.

The upper substrate 10 includes a glass substrate 11, a plurality of transparent electrodes 12, a plurality of bus electrodes 13, a transparent dielectric layer 14 and a protective layer 15. The transparent electrodes 12 are disposed on the glass substrate 11, and the bus electrodes 13 are disposed on the transparent electrodes 12. The transparent electrodes 12 and the bus electrodes 13 are arranged along an X-direction, configuring a plurality of scan electrodes 16 and a plurality of common electrodes 17 disposed alternately. The transparent dielectric layer 14 is disposed on the glass substrate 11 and covers the scan electrodes 16 and the common electrodes 17. The protective layer 15 is disposed on the transparent dielectric layer 14.

The lower substrate 20 includes a glass substrate 21, a plurality of data electrodes 22, a white dielectric layer 23, a rib structure 24 and a fluorescent layer 25. The data electrodes are disposed on the glass substrate 21, and are arranged along a Y-direction. The white dielectric layer 23 is disposed on the glass substrate 21 and covers the data electrodes 22. The rib structure 24 is disposed on the white dielectric layer 23, and defines a plurality of discharging spaces 24*r*, 25*g*, 24*b*, with the upper substrate 10. In the discharging spaces 24*r*, 24*g*, 24*b*, and the rib structure 24 respectively has corresponding fluorescent materials 25*r*, 25*g*, 25*b* for respectively emitting a red light, a green light and a blue light.

The discharging gas 30 is disposed in the discharging spaces 24*r*, 24*g*, 24*b*, defined by the upper substrate 10 and the rib structure 24 of the lower substrate 20.

When an appropriate voltage is applied to the scan electrodes 16, the common electrodes 17 and the data electrodes 22, the discharging gas 30 disposed in the discharging spaces 24*r*, 24*g*, 24*b* is ionized into a plasma, where the atoms of the discharge gas collided with high energy electrons are at an excited state. When returning from the excited state back to a ground state, the atoms emit ultraviolet lights. The ultraviolet lights illuminate the fluorescent materials 25*r*, 25*g*, 25*b*, and the fluorescent materials 25*r*, 25*g*, 25*b* then respectively emit a red light, a green light and a blue light, all of which are adapted to be combined into a white light.

FIG. 1B are top views illustrating scan electrodes and common electrodes of three adjacent discharging spaces. Referring to FIG. 1B, the structures of the scan electrodes 16 and the common electrodes 17 in the discharging spaces 24*r*, 24*g*, 24*b* are the same, and therefore the red light, the green light and the blue light emitted by the fluorescent materials 25*r*, 25*g*, 25*b* can be adjusted in a limited range. Therefore, the light intensity ratio of the red light, the green light and the blue light is not optimal, and accordingly they can not be combined into a white light having a higher color temperature.

There are some other designs of scan electrodes and common electrodes to counter the above disadvantages. FIG. 1C is a top view of another conventional structure of scan electrodes and common electrodes. Referring to FIG. 1C, in order to have the PDP 40 emit a white light with higher color temperature, this conventional design employs arborized electrodes 18*r*, 18*g*, 18*b* to replace the foregoing transparent electrodes 12 disposed in the discharging spaces 24*r*, 24*g*, 24*b*. A white light having higher color temperature can be obtained by adjusting the number of the arborized electrodes 18*r*, 18*g*, 18*b*. However, the branches of the arborized electrodes 18*r*, 18*g*, 18*b* are relatively thin in line width, and accordingly the connecting sessions 18*a* connecting the bus electrodes 13 and the arborized electrodes 18*r*, 18*g*, 18*b* are likely to break during the fabricating process. The discharging spaces with broken arborized electrodes 18*r*, 18*g*, 18*b* cannot display normally.

SUMMARY OF THE INVENTION

According the foregoing description, an objective of the invention is to provide a PDP adapted for emitting a white light having a higher color temperature.

Another objective of the invention is to provide an upper substrate of a PDP for generating higher color temperature.

For achieving the foregoing objects and others, the present invention provides a PDP. The PDP includes a lower substrate and an upper substrate. The lower substrate includes a first substrate, a plurality of data electrodes, a rib structure and a fluorescent layer. The data electrodes are disposed on the first substrate. The rib structure is disposed on the first substrate and covers the data electrodes. The fluorescent layer is disposed on a surface of the rib structure. The upper substrate is disposed over the lower substrate, and configures a plurality of first, second, and third discharging spaces with the rib structure of the lower substrate. The upper substrate includes a second substrate and a plurality of bus electrodes. The bus electrodes are disposed on the second substrate. Each of the bus electrodes includes a plurality of electrode lines and a plurality of connecting sessions to electrically connect the electrode lines. The bus electrodes corresponding to respectively the first, second and third spaces are different in structure, so that the luminance generated by the first, second and third discharging spaces are different from each other.

According to an embodiment of the invention, the connecting sessions respectively corresponding to the bus electrodes of the first, second and third discharging spaces have different linewidths.

According to an embodiment of the invention, the foregoing PDP further includes a plurality of straddle lines, disposed between the electrode lines of respectively the first discharging spaces and the second discharging spaces. According to an aspect of the embodiment, the straddle lines disposed in the first discharging spaces have a linewidth different from that of the straddle lines disposed in the second discharging spaces. According to another aspect of the embodiment, the linewidth of the straddle lines is different from that of the connecting sessions.

According to an embodiment of the invention, the PDP further includes a plurality of middle zones, each of which is configured in each of the first discharging spaces, the second discharging spaces and the third discharging spaces. The distances from such middle zones to the corresponding bus electrodes disposed respectively in the first discharging spaces, the second discharging spaces and the third discharging spaces are different from each other.

According to an embodiment of the invention, the lower substrate further includes a first dielectric layer, disposed between the data electrodes and the rib structure.

According to an embodiment of the invention, the upper substrate further includes a second dielectric layer, covering the bus electrodes.

According to an embodiment of the invention, the upper substrate further includes a protective layer, disposed on the second dielectric layer.

According to an embodiment of the invention, the connecting sessions are made of metal materials.

According to an embodiment of the invention, the foregoing PDP further includes a discharging gas, disposed in the first discharging spaces, the second discharging spaces and the third discharging spaces.

The present invention also provides an upper substrate for a PDP. The PDP includes a first discharging space, a second discharging space and a third discharging space. The upper substrate includes a substrate and a plurality of bus electrodes. The bus electrodes are disposed on the substrate. Each of the bus electrodes includes a plurality of electrode lines and a plurality of connecting sessions to electrically connect the electrode lines. Bus electrodes corresponding to respectively the first, second and third discharging spaces are different from each other in structure, so that the luminance generated by the first, second and third discharging spaces are different from each other.

According to an embodiment of the upper substrate of the invention, the connecting sessions respectively corresponding to the bus electrodes in the first, second and third discharging spaces have different linewidths.

According to an embodiment of the invention, the foregoing PDP further includes a plurality of straddle lines, disposed between the electrode lines of respectively the first discharging spaces and the second discharging spaces. According to an aspect of the embodiment, the straddle lines disposed in the first discharging space has a linewidth different from that of the straddle lines disposed in the second discharging space. According to another aspect of the embodiment, the linewidth of the straddle lines is different from that of the connecting sessions.

According to an embodiment of the invention, the PDP further includes a plurality of middle zones, each of which is configured in each of the first discharging spaces, the second discharging spaces and the third discharging spaces. The distances from such middle zones to the corresponding bus electrodes disposed respectively in the first discharging spaces, the second discharging spaces and the third discharging spaces are different from each other.

According to an embodiment of the invention, the foregoing upper substrate further includes a dielectric layer, covering the bus electrodes.

According to an embodiment of the invention, the upper substrate further includes a protective layer, disposed on the dielectric layer.

According to an embodiment of the invention, the connecting sessions are made of metal materials.

According to the PDP and the upper substrate thereof of the invention, the bus electrodes corresponding to different discharging spaces of the upper substrate are different in structure. Therefore, the desired intensity ratio of the red light, the green light and the blue light can be achieved for obtaining a white light having a higher color temperature. Accordingly, the PDP displays sharper image quality.

BRIEF DESCRIPTION OF THE DRAWING

The features of the invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DESCRIPTION OF THE EMBODIMENTS

The First Embodiment

Figure 1A:
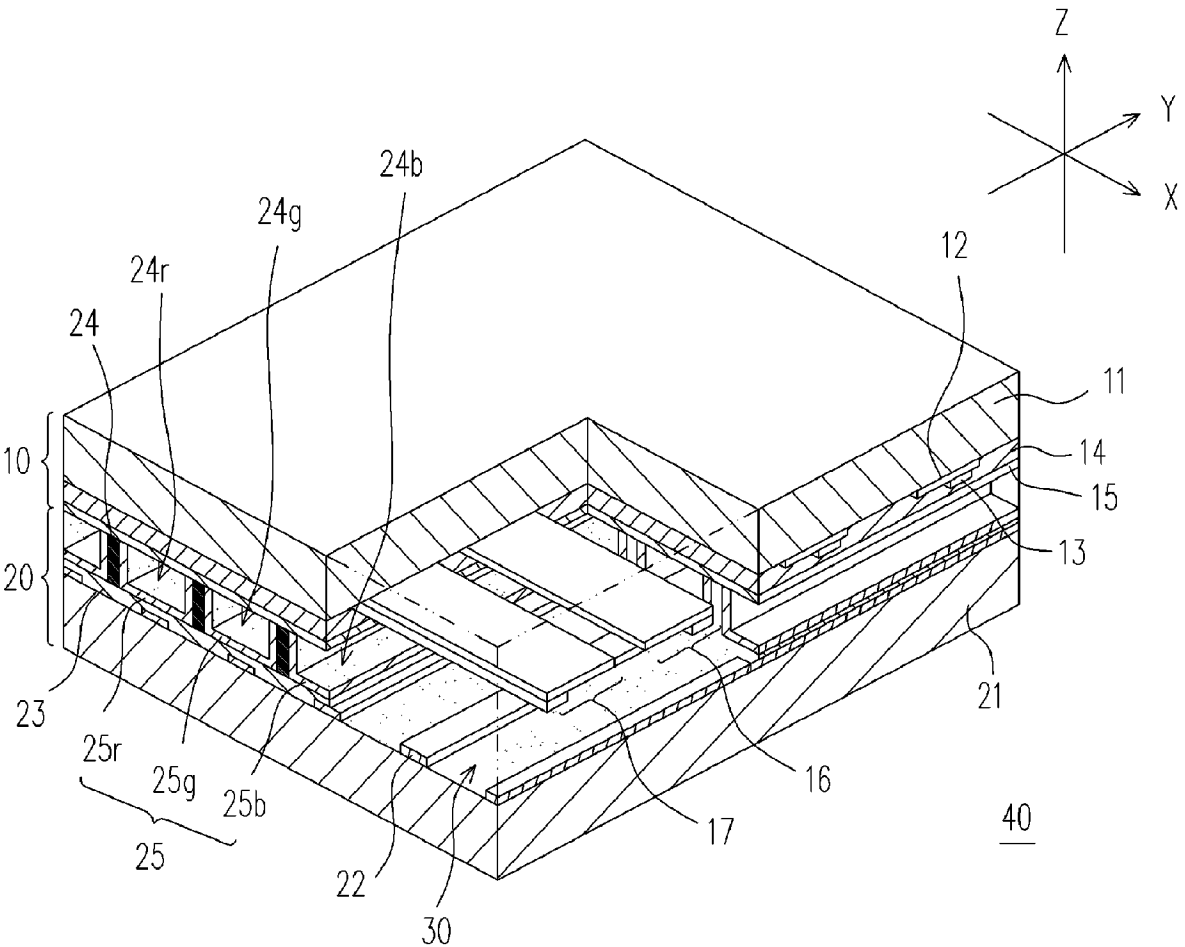
FIG. 1A (PRIOR ART)
FIG. 1A is a schematic structural view of a conventional PDP.
Figure 1B:
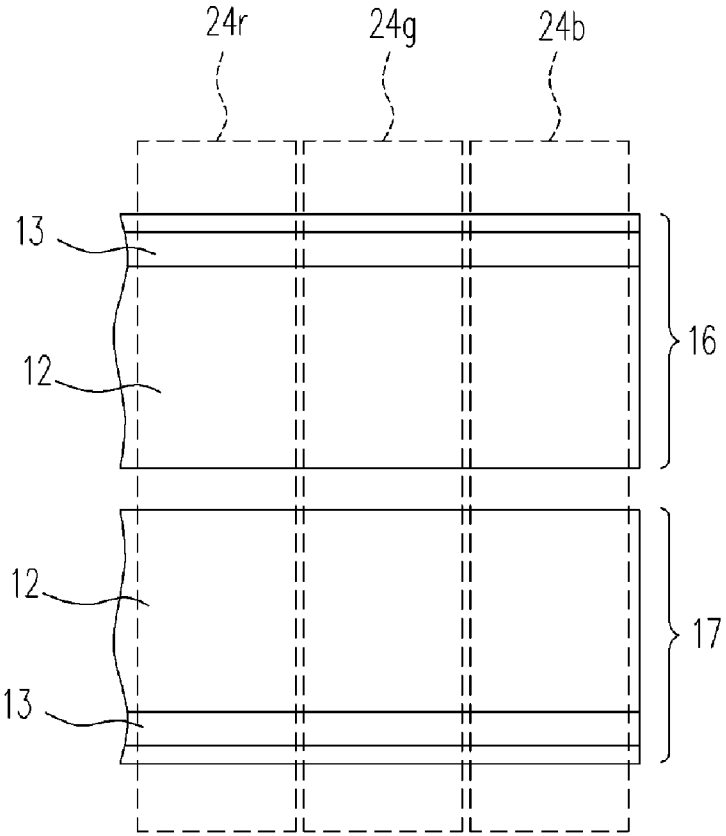
FIG. 1B (PRIOR ART)
FIG. 1B are top views illustrating scan electrodes and common electrodes of three adjacent discharging spaces shown in FIG. 1A.
Figure 1C:
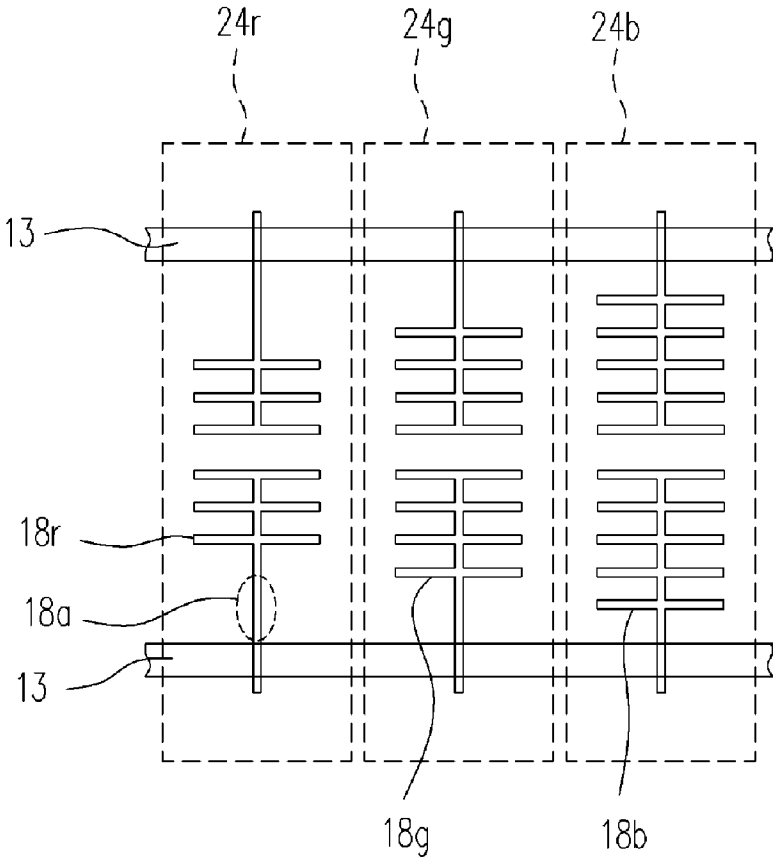
FIG. 1C (PRIOR ART)
FIG. 1C is a top view of another conventional structure of scan electrodes and common electrodes.
Figure 2A:
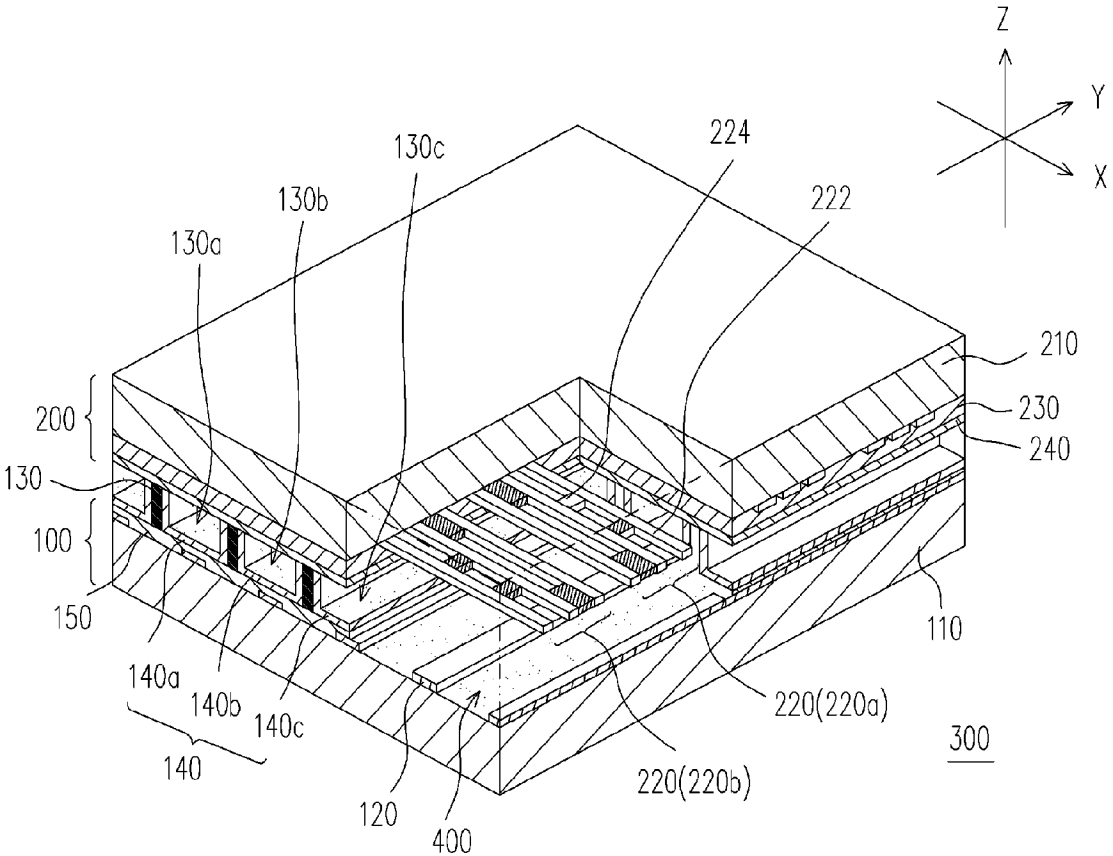
FIG. 2A is a schematic structural view of a PDP according to the first embodiment of the invention.

FIG. 2A is a schematic structural view of a PDP according to the first embodiment of the invention. Referring to FIG. 2A, a plasma display panel (PDP) 300 includes a lower substrate 100 and an upper substrate 200. The lower substrate 100 and the upper substrate 200 are illustrated in details below.

The lower substrate 100 includes a first substrate 110, a plurality of data electrodes 120, a rib structure 130 and a fluorescent (or phosphor) layer 140. The first substrate 110 for example is a glass substrate, a quartz substrate or a substrate made of other appropriate materials. The data electrodes 120 for example are made of a metal, an alloy or other appropriate electrically conductive materials. The data electrodes 120 are disposed on the first substrate 110 along the X-direction of FIG. 2A. The rib structure 130 is disposed on the first substrate 110 and covers the data electrodes 120. The fluorescent layer 140 is disposed on a surface of the rib structure 130.

The upper substrate 200 is disposed over the lower substrate 100, and configures a plurality of first discharging spaces 130*a*, a plurality of second discharging spaces 130*b*, and a plurality of third discharging spaces 130*c* with the rib structure 130 of the lower substrate 100. The upper substrate 200 includes a second substrate 210 and a plurality of bus electrodes 220. The second substrate 210 for example is a glass substrate, a quartz substrate or a substrate made of other appropriate materials. The data electrodes 220 for example are made of a metal, an alloy or other appropriate electrically conductive materials. The bus electrodes 220 are disposed on the second substrate 210 along the Y-direction of FIG. 2A. Bus electrodes 220 correspondingly disposed in a row or a column of discharging spaces include scan electrodes 220*a* and common electrodes 220*b*. Each of the electrodes 220 includes a plurality of electrode lines 222 and a plurality of connecting sessions 224 to electrically connect the electrode lines. The connecting sessions 224 are made of a metal material or other appropriate electrically conductive and light-shielding materials. Bus electrodes 220 corresponding to respectively the first discharging spaces 130*a*, the second discharging spaces 130*b* and the third discharging spaces 130*c* are different in structure, so that the luminance generated by the first discharging spaces 130*a*, the second discharging spaces 130*b* and the third discharging spaces 130*c* are different.

According to the embodiment, the fluorescent layer 140 includes a plurality of first fluorescent materials 140*a*, second fluorescent materials 140*b* and third fluorescent materials 140*c*. The first fluorescent materials 140*a*, the second fluorescent materials 140*b*, and the third fluorescent material 140*c* are respectively disposed on a surface of the rib structure 130, respectively corresponding to the first discharging spaces 130*a*, the second discharging spaces 130*b* and the third discharging spaces 130*c*. According to the embodiment, the first fluorescent materials 140*a*, the second fluorescent materials 140*b*, and the third fluorescent materials 140*c* are made of fluorescent materials respectively for emitting a red light, a green light and a blue light. Noted that, in other embodiments, the first fluorescent materials 140*a*, the second fluorescent materials 140*b*, and the third fluorescent materials 140*c* can also be fluorescent materials for emitting lights of other colors.

In order to obtain an ultraviolet light for exciting the first fluorescent materials 140*a*, the second fluorescent materials 140*b*, and the third fluorescent materials 140*c* to emit respectively a red light, a green light and a blue light, the PDP 300 further includes a discharging gas 400. The discharging gas for example is xenon, helium, neon, composite gas including inert gas or other appropriate gases. The discharging gas 400 is disposed within the first discharging spaces 130*a*, the second discharging spaces 130*b* and the third discharging spaces 130*c*. According to an aspect of the embodiment, the lower substrate 100 further includes a first dielectric layer 150. The first dielectric layer 150 for example is made of silicon oxide or other appropriate materials, and is disposed between the data electrodes 120 and the rib structure 130. According to another aspect of the embodiment, the upper substrate 200 further includes a second dielectric layer 230 and a protective layer 240. The second dielectric layer 230 for example is made of silicon oxide or other appropriate materials, and is disposed on the bus electrodes 220. The protective layer 240 for example is made of magnesia or other appropriate materials and is disposed on the second dielectric layer 230.

Figure 2B:
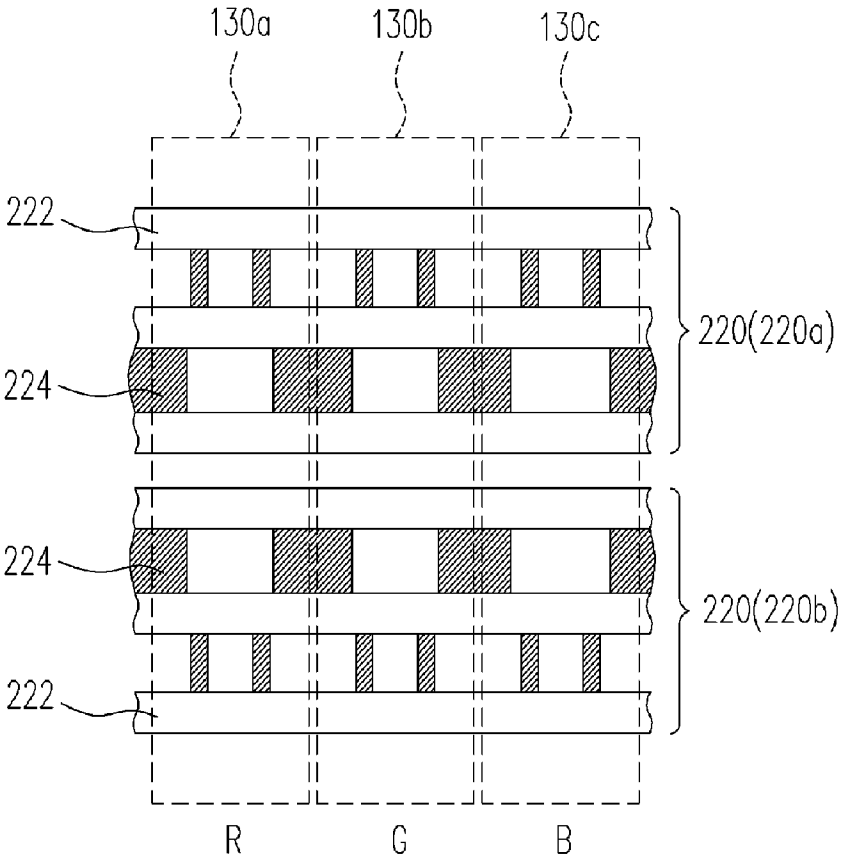
FIG. 2B are top views illustrating scan electrodes and common electrodes of three adjacent discharging spaces shown in FIG. 2A.

The present invention provides several structural designs for the bus electrodes 220 disposed in the first discharging spaces 130*a*, the second discharging spaces 130*b* and the third discharging spaces 130*c*. According to an embodiment of the invention as shown in FIG. 2B, top views illustrating scan electrodes and common electrodes of three adjacent discharging spaces shown in FIG. 2A, in order to achieve a desired intensity ratio of the red light, the green light and the blue light emitted by the first fluorescent materials 140*a*, the second fluorescent materials 140*b* and the third fluorescent materials 140*c*, the connecting sessions 224 respectively corresponding to the bus electrodes 220 in the first discharging spaces 130*a*, the second discharging spaces 130*b* and the third discharging spaces 130*c* have different linewidths. In details, in the first discharging spaces 130*a*, the second discharging spaces 130*b* and the third discharging spaces 130*c*, there are some connecting sessions 224 with line widths different from the others. When an appropriate voltage is applied to the data electrode 120, the scan electrodes 220*a* and the common electrodes 220*b*, the connecting sessions 224 having different linewidths in the first discharging spaces 130*a*, the second discharging spaces 130*b* and the third discharging spaces 130*c* are adapted for sheltering parts of the red light, the green light and the blue light emitting by the first fluorescent materials 140*a*, the second fluorescent materials 140*b*, the third fluorescent materials 140*c*. Therefore, the desired intensity ratio of the red light, the green light and the blue light can be achieved for obtaining a white light having a higher color temperature (about 9000K) and accordingly the PDP 300 may display sharper image quality.

Note that, even if one of the connecting sessions 224 is broken, the electrode lines 222 are kept electrically conducted via the rest connecting sessions 224 and the PDP may still display images. It is because the electrode lines 222 are electrically connected by many connecting sessions 224, in the first discharging spaces 130*a*, the second discharging spaces 130*b*, and the third discharging spaces 130*c*.

The Second Embodiment

Figure 3A:
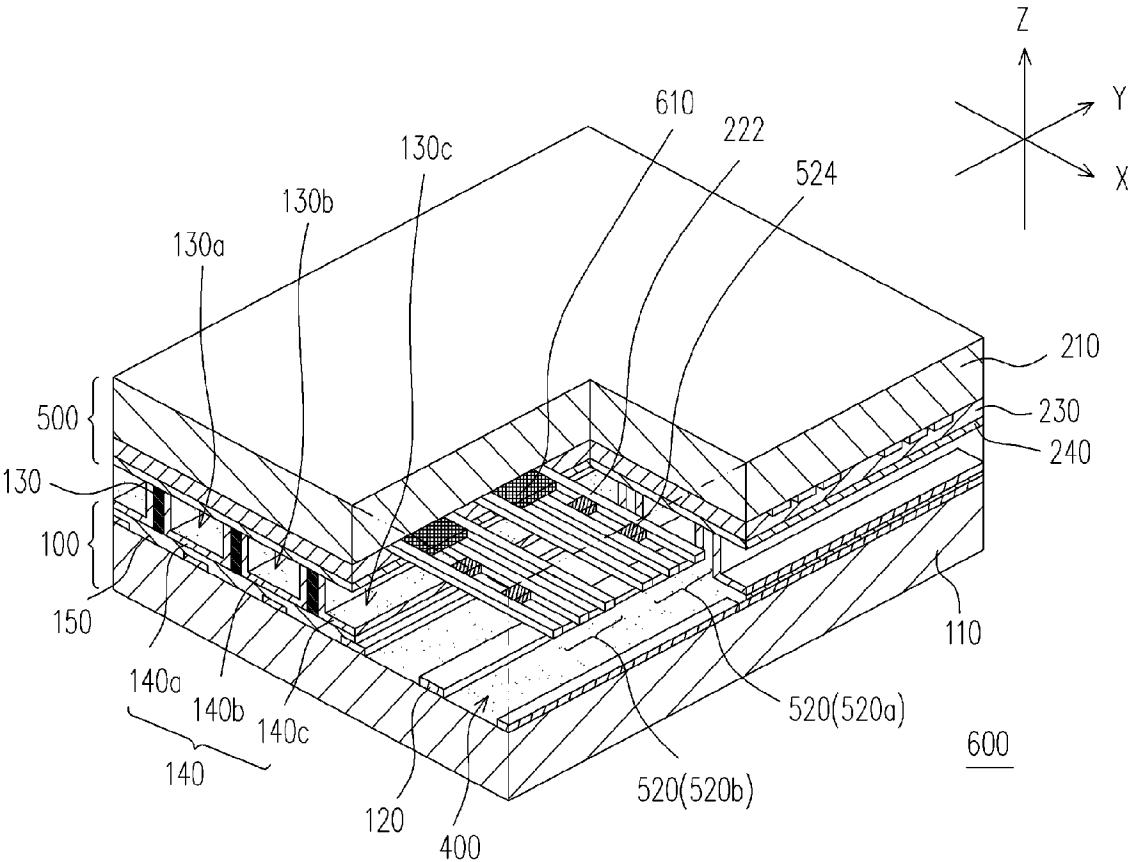
FIG. 3A is a schematic structural view of a PDP according to the second embodiment of the invention.
Figure 3B:
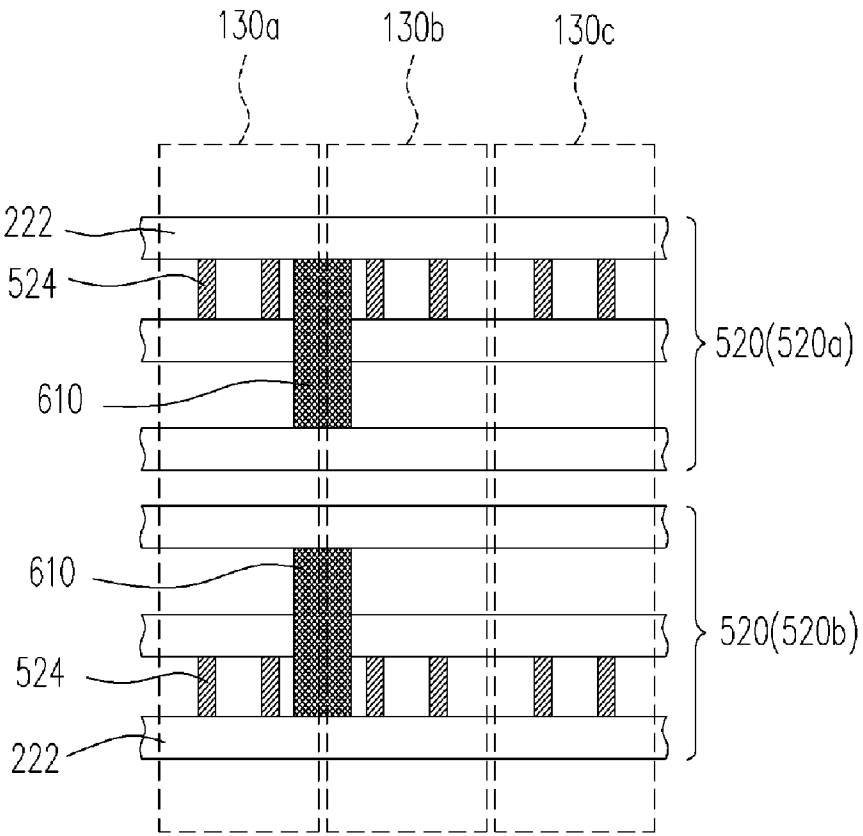
FIG. 3B are top views illustrating scan electrodes and common electrodes of three adjacent discharging spaces shown in FIG. 3A.

FIG. 3A is a schematic structural view of a PDP according to the second embodiment of the invention. FIG. 3B are top views illustrating scan electrodes and common electrodes of three adjacent discharging spaces shown in FIG. 3A. Referring to FIGS. 3A and 3B, the PDP 600 according to the second embodiment is similar to the foregoing PDP 300 illustrated in the foregoing first embodiment. According to the second embodiment, the first fluorescent materials 140*a* disposed in the first discharging spaces 130*a* are preferably adapted for emitting a red light; the second fluorescent materials 140*b* disposed in the second discharging spaces 140*b* are preferably adapted for emitting a green light; and the third fluorescent material 140*c* disposed in the third discharging spaces 140*c* are preferably adapted for emitting a blue light. The PDP 600 further includes a plurality of straddle lines 610 disposed between the electrode lines 222 of respectively the first discharging spaces 130*a* and the second discharging spaces 130*b*. The straddle lines 610 are made of metal materials or other appropriate light sheltering materials. According to an aspect of the second embodiment, the straddle lines 610 disposed in the first discharging spaces 130*a* has a linewidth different from that of the straddle lines 610 disposed in the second discharging space 130*b*. According to another aspect of the embodiment, the linewidth of the straddle lines 610 is different from that of the connecting sessions 524. In other words, according to the embodiment shown in FIGS. 3A and 3B, the luminance ratio between the lights emitted from respectively the first discharging spaces 130*a*, the second discharging spaces 130*b* and the third discharging spaces 130*c* can be optimized for combining into a white light having a higher color temperature, by employing the straddle lines 610 and/or even the connecting sessions 524 with different linewidths.

Similarly, Note that, the second embodiment employs the fluorescent materials respectively adapted for emitting a red light, a green light and a blue light as an example. In other embodiments, the first fluorescent materials 140*a*, the second fluorescent materials 140*b*, and the third fluorescent materials 140*c* can also be fluorescent materials for emitting lights of other colors.

The Third Embodiment

Figure 4A:
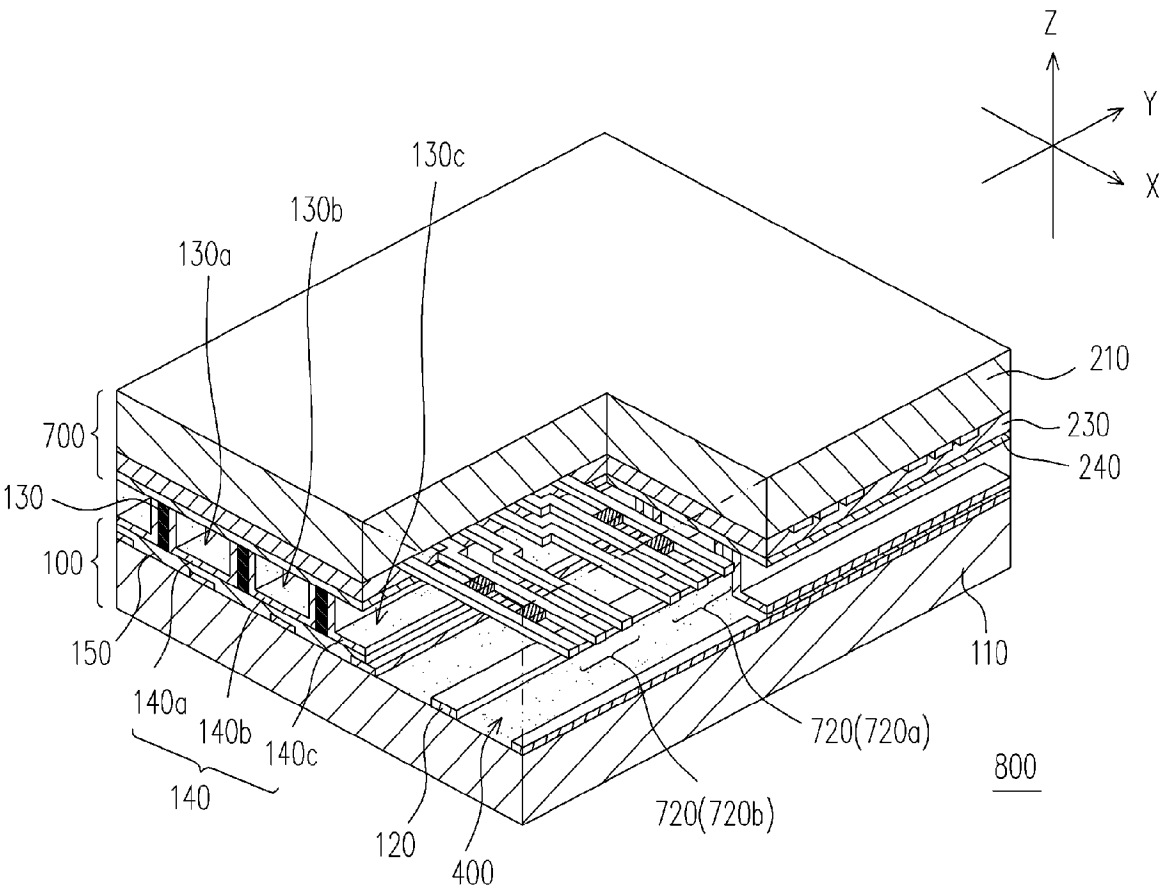
FIG. 4A is a schematic structural view of a PDP according to the third embodiment of the invention.
Figure 4B:
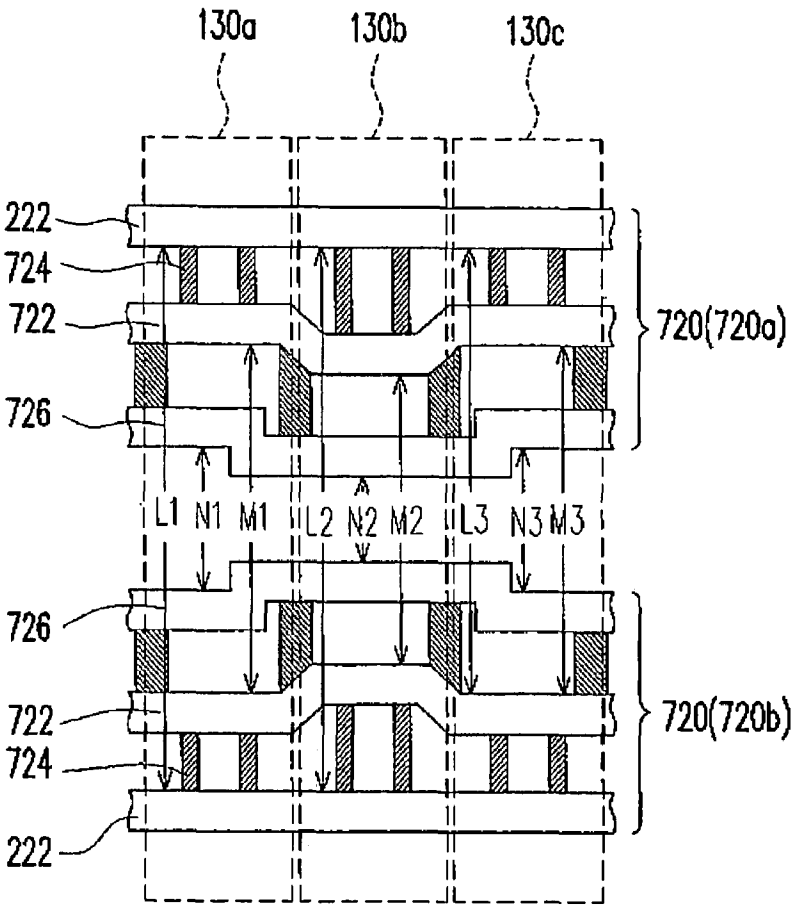
FIG. 4B are top views illustrating scan electrodes and common electrodes of three adjacent discharging spaces shown in FIG. 4A.

FIG. 4A is a schematic structural view of a PDP according to the third embodiment of the invention. FIG. 4B are top views illustrating scan electrodes and common electrodes of three adjacent discharging spaces shown in FIG. 4A. Referring to FIGS. 4A and 4B, the PDP 800 according to the second embodiment is similar to the foregoing PDP 300 illustrated in the foregoing first embodiment. According to the third embodiment, the distances between bus electrodes 720 disposed respectively in the first discharging spaces 130*a*, the second discharging spaces 130*b* and the third discharging spaces 130*c* are different from each other. In details, the distances N1 between the electrode lines 726 in the first discharging spaces 130*a*, the distance N2 between the electrode lines 726 in the second discharging spaces 130*b* and the distance N3 between the electrode lines 726 in the third discharging spaces 130*c* are different from each other. Alternatively, the distances M1 between the electrode lines 722 in the first discharging spaces 130*a*, the distances M2 between the electrode lines 722 in the second discharging spaces 130*b* and the distances M3 between the electrode lines 722 in the third discharging spaces 130*c* are different from each other.

In details, in the first discharging spaces 130*a*, the distance between the electrode line 222 of the bus electrode 720*a* and the electrode line 222 of the bus electrode 720*b* is L1; the distance between the electrode line 726 of the bus electrode 720*a* and the electrode line 726 of the bus electrode 720*b* is N1; and the distance between the electrode line 722 of the bus electrode 720*a* and the electrode line 722 of the bus electrode 720*b* is M1. In the second discharging spaces 130*b*, the distance between the electrode line 222 of the bus electrode 720*a* and the electrode line 222 of the bus electrode 720*b* is L2; the distance between the electrode line 726 of the bus electrode 720*a* and the electrode line 726 of the bus electrode 720*b* is N2; and the distance between the electrode line 722 of the bus electrode 720*a* and the electrode line 722 of the bus electrode 720*b* is M2. In the third discharging spaces 130*c*, the distance between the electrode line 222 of the bus electrode 720*a* and the electrode line 222 of the bus electrode 720*b* is L3; the distance between the electrode line 726 of the bus electrode 720*a* and the electrode line 726 of the bus electrode 720*b* is N3; and the distance between the electrode line 722 of the bus electrode 720*a* and the electrode line 722 of the bus electrode 720*b* is M3. These distances as above mentioned may have a relationship as following:

$$L1>N1>M1,\ L2>N2>M2,\ L3>N3>M3,\ L1=L2\neq L3; \quad (1)$$

$$L1>N1>M1,\ L2>N2>M2,\ L3>N3>M3,\ N1=N2\neq N3; \quad (2)$$

$$L1>N1>M1,\ L2>N2>M2,\ L3>N3>M3,\ M1=M2\neq M3; \quad (3)$$

$$L1>N1>M1,\ L2>N2>M2,\ L3>N3>M3,\ L1\neq L2\neq L3; \quad (4)$$

$$L1>N1>M1,\ L2>N2>M2,\ L3>N3>M3,\ N1\neq N2\neq N3; \quad (5)$$

$$L1>N1>M1,\ L2>N2>M2,\ L3>N3>M3,\ M1\neq M2\neq M3; \quad (6)$$

Generally, in the discharging spaces 130*a*, 130*b* and 130*c*, the discharging gas proximate to the middle zones M has better discharging efficiency than discharging gas at sides. Therefore, the middle zone M of each of the first discharging spaces 130*a*, the second discharging spaces 130*b* and the third discharging spaces 130*c* has relatively higher luminance. According to the third embodiment, the distances from such middle zones M (or sub-middle zones N) to the corresponding bus electrodes 720 (222, 722 or 726) disposed respectively in the first discharging spaces 130*a*, the second discharging spaces 130*b* and the third discharging spaces 130*c* are different from each other. Accordingly, discharging spaces having bus electrodes disposed closer to corresponding middle zones M produce lower luminance. Similarly, discharging spaces having bus electrodes disposed farther from corresponding middle zones M produce higher luminance.

When an appropriate voltage is applied to the data electrode 120, the scan electrodes 720*a* and the common electrodes 720*b*, because differences from the electrode lines 722, 222 and 726 to the corresponding middle zones M respectively of the first discharging spaces 130*a*, the second discharging spaces 130*b* and the third discharging spaces 130*c* are different, the red light, the green light and the blue light respectively emitted from the first discharging spaces 130*a*, the second discharging spaces 130*b* and the third discharging spaces 130*c* are also different. Thus, by appropriate design of the middle zones M and the electrode lines 722 in respectively the first discharging spaces 130*a*, the second discharging spaces 130*b* and the third discharging spaces 130*c*, the desired intensity ratio of the red light, the green light and the blue light can be achieved for obtaining a white light having a higher color temperature (about 9000K) and accordingly the PDP 800 may display sharper image quality.

In summary, the PDP and the upper substrate thereof according to the present invention have at least the following advantages:

The PDP and the upper substrate thereof according to the present invention include connecting sessions having different linewidths corresponding to different discharging spaces or straddle lines having different linewidths disposed between electrode lines for sheltering parts of light emitted by the fluorescent layer. Consequently, the desired intensity ratio of the red light, the green light and the blue light emitting from the upper substrate can be achieved for obtaining a white light having a higher color temperature and accordingly the PDP may display sharper images.

The present invention can also design different distances from the bus electrodes in different discharging spaces to corresponding middle zones for having different discharging spaces to emit different luminance, thus enabling the PDP to emit a white light having a higher color temperature.

According to the upper substrate of the present invention, the electrode lines are electrically connected by a plurality of connecting sessions. During a process of fabricating such an upper substrate, if one of the connecting sessions is broken, the electrode lines can be kept electrically conducted by the remaining connecting sessions, and the PDP can still display images.

Other modifications and adaptations of the above-described preferred embodiments of the present invention may be made to meet particular requirements. This disclosure is intended to exemplify the invention without limiting its scope. All modifications that incorporate the invention disclosed in the preferred embodiment are to be construed as coming within the scope of the appended claims or the range of equivalents to which the claims are entitled.

What is claimed is:

1. A plasma display panel (PDP), comprising:

a lower substrate, comprising:

a first substrate;

a plurality of data electrodes, disposed on the first substrate and extending in a first direction;

a rib structure, disposed on the first substrate and covering the data electrodes; and a fluorescent layer, disposed on a surface of the rib structure; and an upper substrate disposed over the lower substrate, configuring a plurality of first, second, and third discharging spaces with the rib structure of the lower substrate, the upper substrate comprising:

a second substrate;

a plurality of bus electrodes, disposed on the second substrate, each of the bus electrodes comprising a plurality of electrode lines extending in a second direction perpendicular to the first direction and a plurality of connecting sessions to electrically connect the electrode lines, wherein the bus electrodes corresponding to respectively the first discharging spaces, the second discharging spaces and the third discharging spaces are different in structure, so that the luminance generated by the first discharging spaces, the second discharging spaces and the third discharging spaces are different from each other; and a plurality of straddle lines, disposed between two of the electrode lines of respectively the first discharging spaces and the second discharging spaces and straddling at least one of the electrode lines in the first direction, wherein the straddle lines disposed in the first discharging spaces have a linewidth different from the linewidth of the straddle lines disposed in the second discharging spaces in the second direction.

2. The PDP according to claim 1, wherein the connecting sessions respectively corresponding to the bus electrodes of the first discharging spaces, the second discharging spaces and the third discharging spaces at least partially have different linewidths in the second direction.

3. The PDP according to claim 1, wherein the linewidth of the straddle lines is different from the linewidth of the connecting sessions in the second direction.

4. The PDP according to claim 1, wherein the distances between the corresponding bus electrodes disposed respectively in the first discharging spaces, the second discharging spaces and the third discharging spaces being different from each other.

5. The PDP according to claim 1, wherein the lower substrate further comprises a first dielectric layer, disposed between the data electrodes and the rib structure.

6. The PDP according to claim 1, wherein the upper substrate further comprises a second dielectric layer, covering the bus electrodes.

7. The PDP according to claim 6, wherein the upper substrate further comprises a protective layer, disposed on the second dielectric layer.

8. The PDP according to claim 1, wherein the material of the connecting sessions comprises metal materials.

9. The PDP according to claim 1 further comprising a discharging gas, disposed in the first discharging spaces, the second discharging spaces and the third discharging spaces.

10. An upper substrate for a PDP, the PDP comprising a plurality of first discharging spaces, second discharging spaces and third discharging spaces, the upper substrate comprising:

a substrate;

a plurality of bus electrodes, disposed on the substrate, each of the bus electrodes comprising a plurality of electrode lines extending in a first direction and a plurality of connecting sessions to electrically connect the electrode lines, wherein the bus electrodes corresponding to respectively the first discharging spaces, the second discharging spaces and the third discharging spaces are different in structure, so that the luminance generated by the first discharging spaces, the second discharging spaces and the third discharging spaces are different from each other; and a plurality of straddle lines, disposed between two of the electrode lines of respectively the first discharging spaces and the second discharging spaces and straddling at least one of the electrode lines in a second direction perpendicular to the first direction, wherein the straddle lines disposed in the first discharging spaces have a linewidth different from the linewidth of the straddle lines disposed in the second discharging spaces in the first direction.

11. The upper substrate according to claim 10, wherein the connecting sessions respectively corresponding to the bus electrodes of the first discharging spaces, the second discharging spaces and the third discharging spaces at least partially have different linewidths in the first direction.

12. The upper substrate according to claim 10, wherein the linewidth of the straddle lines is different from the linewidth of the connecting sessions in the first direction.

13. The upper substrate according to claim 10, wherein the distances between the corresponding bus electrodes disposed respectively in the first discharging spaces, the second discharging spaces and the third discharging spaces being different from each other.

14. The upper substrate according to claim 10, further comprising a dielectric layer, covering the bus electrodes.

15. The upper substrate according to claim 10, further comprising a protective layer, disposed on the dielectric layer.

16. The upper substrate according to claim 10, wherein the connecting sessions are made of metal materials.

* * * * *